US011194355B2

(12) United States Patent
Kommaraju et al.

(10) Patent No.: US 11,194,355 B2
(45) Date of Patent: Dec. 7, 2021

(54) ADAPTIVE POWER ADJUSTMENT FOR CURRENT OUTPUT CIRCUIT

(71) Applicant: TEXAS INSTRUMENTS INCORPORATED, Dallas, TX (US)

(72) Inventors: Navin Venkata Kommaraju, Irving, TX (US); Rahul Prakash, McKinney, TX (US); Chintan Trehan, Fairview, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 1084 days.

(21) Appl. No.: 14/505,054

(22) Filed: Oct. 2, 2014

(65) Prior Publication Data

US 2015/0097545 A1 Apr. 9, 2015

Related U.S. Application Data

(60) Provisional application No. 61/887,188, filed on Oct. 4, 2013.

(51) Int. Cl.
*G05F 1/12* (2006.01)
*G05F 1/46* (2006.01)

(52) U.S. Cl.
CPC . *G05F 1/12* (2013.01); *G05F 1/46* (2013.01)

(58) Field of Classification Search
CPC ..... G05F 1/12; G05F 1/46; G05F 1/10; G05F 1/618; G05F 1/14; G05F 1/563; G05F 1/575; G05F 1/613; G05F 1/66; G05F 1/67; G05F 1/70; G05F 3/02
USPC ..... 323/220, 226, 264, 269, 268
See application file for complete search history.

(56) References Cited

U.S. PATENT DOCUMENTS 8,952,666 B2 * 2/2015 Quan ..... H02M 3/155 323/268
2006/0025101 A1 * 2/2006 Li ..... H04W 52/04 455/323
2008/0042632 A1 * 2/2008 Chapuis ..... H02M 3/157 323/283
2009/0256537 A1 * 10/2009 Sato ..... H02M 3/1584 323/272
2013/0342177 A1 * 12/2013 Slattery ..... H02M 3/156 323/234

(Continued)

*Primary Examiner* — Thienvu V Tran
*Assistant Examiner* — Lorena D Bruner
(74) *Attorney, Agent, or Firm* — Ray A. King; Charles A. Brill; Frank D. Cimino

(57) ABSTRACT

A circuit includes an output current circuit that employs a regulated voltage to provide an output voltage to drive a load current through an output load resistor. A load resistance sensor (LRS) senses the resistance of the output load resistor based on the output voltage and the load current. A controller provides a sense voltage control command to set the regulated voltage to an initial sense voltage during a sense mode. The initial sense voltage adjusts the output voltage of the output current circuit and enables the LRS to sense the resistance of the output load resistor at a given setting of the load current. The controller provides a clamp control command based on the sensed resistance of the output load resistor to set the regulated voltage to a fixed regulated voltage during an operation mode. The fixed regulated voltage enables the output current circuit to supply a predetermined maximum load current to the output load resistor at a predetermined minimum setting of the output voltage.

15 Claims, 3 Drawing Sheets

(56) References Cited

U.S. PATENT DOCUMENTS

| | | | | |
|---|---|---|---|---|
| 2015/0022259 | A1* | 1/2015 | Gong | G05F 1/46 327/538 |
| 2016/0026199 | A1* | 1/2016 | El-Nozahi | G05F 1/575 323/274 |
| 2017/0331371 | A1* | 11/2017 | Parto | G05F 1/46 |

* cited by examiner

ADAPTIVE POWER ADJUSTMENT FOR CURRENT OUTPUT CIRCUIT

CROSS-REFERENCE TO RELATED APPLICATION

This application claims the benefit of U.S. Provisional Patent Application 61/887,188 filed on Oct. 4, 2013, and entitled AUTO-LOAD DETECTION AND LEARNING MODE CLAMP TO MINIMIZE SETTLING TIME AND POWER DISSIPATION FOR CURRENT OUTPUT DIGITAL-TO-ANALOG CONVERTERS, the entirety of which is incorporated by reference herein.

TECHNICAL FIELD

This disclosure relates to electrical circuits and, more particularly, to adaptive power adjustment for a current output circuit.

BACKGROUND

Current output Digital to Analog Converter (DAC) circuits have varying load requirements that often range from driving short circuit conditions to driving load currents through larger values of resistance. Depending on the commanded current value of the DAC and the value of the load resistance, more or less power is expended at the output of the DAC to ensure the desired current is provided over a wide range of load conditions. In some applications, DAC's can supply analog output modules with current outputs (e.g., 4-24 mA) in industrial control applications and dissipate up to 600 milliwatts per channel (e.g., 24V×24 mA) when connected to very small load resistances where short conditions are considered a normal load. One method to address this power issue is to adaptively buck/boost the power supply supplying the DAC output driver circuit through a DC-DC switching converter based on the load resistance. However, this method can suffer from a large settling time for the DAC outputs (especially on large DAC step sizes).

SUMMARY

This disclosure relates to adaptive power adjustment for a current output circuit.

In one example, a circuit includes an output current circuit that employs a regulated voltage to provide an output voltage to drive a load current through an output load resistor. A load resistance sensor (LRS) senses the resistance of the output load resistor based on the output voltage and the load current. A controller provides a sense voltage control command to set the regulated voltage to an initial sense voltage during a sense mode. The initial sense voltage adjusts the output voltage of the output current circuit and enables the LRS to sense the resistance of the output load resistor at a given setting of the load current. The controller provides a clamp control command based on the sensed resistance of the output load resistor to set the regulated voltage to a fixed regulated voltage during an operation mode. The fixed regulated voltage enables the output current circuit to supply a predetermined maximum load current to the output load resistor at a predetermined minimum setting of the output voltage.

In another example, a circuit includes a digital to analog converter (DAC) that converts a digital current control input to an analog output to specify a load current supplied to an output load resistor. An output driver circuit receives a regulated voltage to provide an output voltage to drive the load current through the output load resistor. A load resistance sensor (LRS) senses the resistance of the output load resistor based on the output voltage. A controller provides a voltage control command to set the regulated voltage to an initial sense voltage during a sense mode and enables the LRS to sense the resistance of the output load resistor sense voltage based on the output voltage provided by the output driver circuit during the sense mode. The controller provides a clamp control command based on the sensed resistance of the output load resistor to set the regulated voltage to a fixed regulated voltage during an operation mode. The fixed regulated voltage enables the output driver circuit to supply a predetermined maximum load current to the output load resistor at a predetermined minimum setting of the output voltage.

In yet another example, a method includes setting a regulated voltage to an initial sense voltage during a sense mode. The initial sense voltage adjusts an output voltage of an output current circuit to an output load resistor at a given setting of load current. The method includes sensing a resistance of the output load resistor based on the output voltage and the load current. The method includes setting the regulated voltage to a fixed regulated voltage during an operation mode. The fixed regulated voltage enables the output current circuit to supply a predetermined maximum load current to the output load resistor at a predetermined minimum setting of the output voltage.

DETAILED DESCRIPTION

This disclosure relates to an output current circuit that utilizes adaptive power adjustment, in view of a sensed load resistance, to balance output power dissipation and current settling time in the circuit. For example, the output current circuit can include a digital to analog (DAC) output circuit and a voltage converter (e.g., DC-DC converter, linear supply) to adjust output voltages that supply current in a DAC output driver stage. For example, a controller commands the value of the voltage converter output voltage to a fixed or clamp value that is determined based on the sensed load resistance during a sensing mode and is used during normal operation. As a result, the circuit affords a balance between power dissipation and settling time in the circuit.

As an example, the controller selects an initial voltage for the voltage converter to drive the output driver circuit and to enable the LRS to sense the resistance of the output load resistor. The initial voltage can be based on predetermined load conditions and an internal circuit threshold, for example. After the resistance of the output load resistor is determined by the LRS and the controller, the controller selects a clamp voltage to set an output voltage for the output driver circuit based on the determined resistance value such that a predetermined load current is delivered (e.g., maximum load current) to the output load resistor at the output voltage (e.g., minimum voltage to supply maximum load current).

The clamp voltage is then employed to set the voltage converter voltage at a fixed level for continuing circuit operations regardless of changes to the DAC current output value. The predetermined load current can be based on predetermined maximum load current conditions, for example. Thus, the clamp voltage can be set to minimize output power in the DAC output circuit under maximum load current conditions in view of the determined resistance. By clamping the output voltage to a fixed value, settling time of the DAC output stage is mitigated since commanded current changes to the DAC do not cause a subsequent change in voltage converter output voltage. Thus, a balance can be achieved by minimizing power under maximum load current conditions at the determined resistance and mitigating settling time issues by holding the voltage converter at a substantially constant level regardless of DAC current changes.

Figure 1:
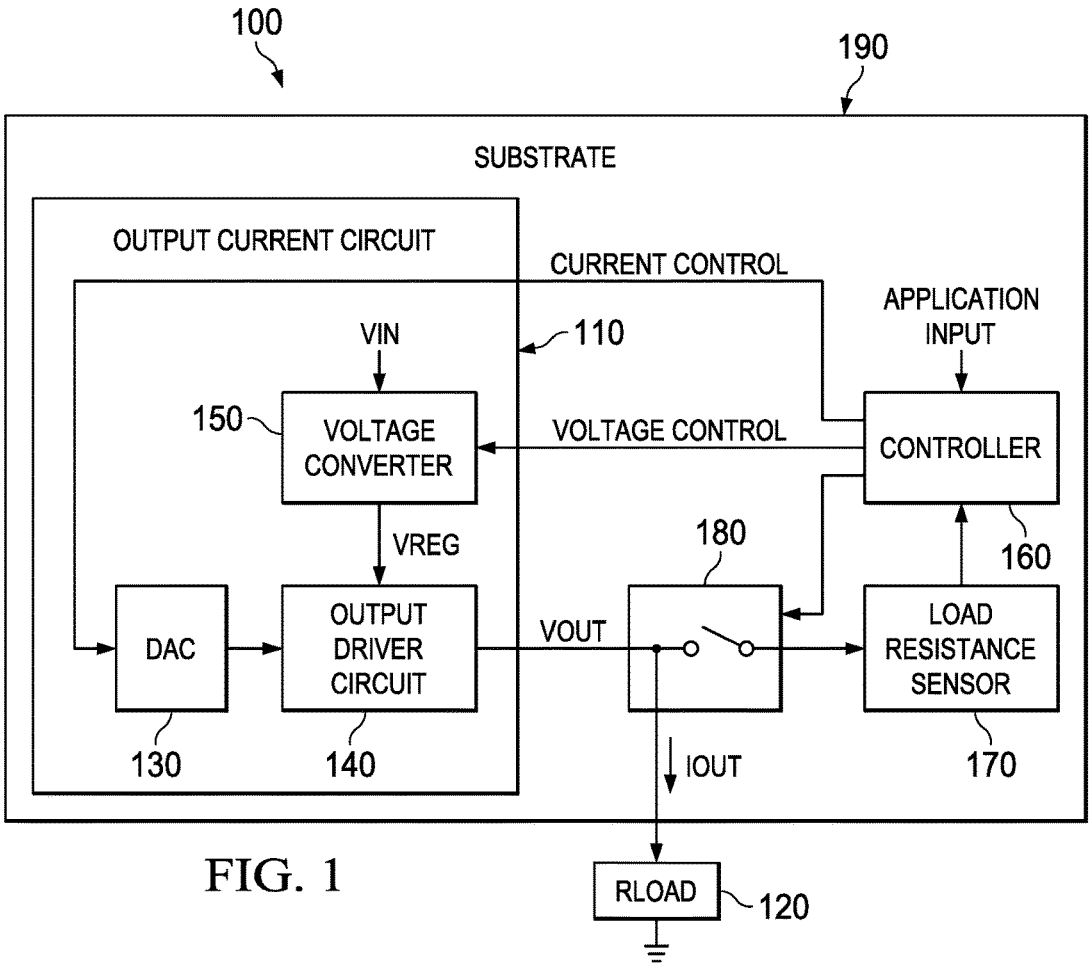
FIG. 1 illustrates an example of a circuit to generate current to an output load resistor.

FIG. 1 illustrates an example of a circuit 100 to generate current to an output load resistor. As used herein, the term "circuit" can include a collection of active and/or passive elements that perform a circuit function such as an amplifier or comparator, for example. The term circuit can also include an integrated circuit where all the circuit elements are fabricated on a common substrate, for example. As used herein the term substrate can refer to an integrated circuit material (e.g., silicon) where some or all the circuit elements are fabricated thereon. The term substrate can also include a printed circuit board. In some examples, a substrate can include both a printed circuit board and an integrated circuit material to form the circuit 100.

The circuit 100 includes an output current circuit 110 to supply current (IOUT) to a load resistor RLOAD 120. The resistor RLOAD 120 can have a value in ohms which can represent a resistance and/or an impedance value, for example. The output current circuit 110 can include a digital to analog converter (DAC) 130 that converts a digital input to an analog output to specify the load current IOUT supplied to RLOAD 120. By way of example, the DAC 130 can specify a percentage of IOUT (e.g., full scale DAC output equals maximum IOUT, ½ scale DAC output specifies ½ full scale of maximum, and so forth). Output from the DAC 130 is provided to an output driver circuit 140 that receives a regulated voltage (VREG) from voltage converter 150 to provide an output voltage (VOUT) to drive the specified load current (IOUT) of the DAC through RLOAD 120. Depending on the specified output current from the DAC 130, the resistance of RLOAD 120, and VREG from the voltage converter 150, the output driver circuit 130 adjusts VOUT to supply IOUT specified by the DAC to RLOAD.

In one example, the voltage converter 150 can be a DC-DC converter (e.g., buck and/or boost converter) converter that increases or decreases the voltage VREG based on an input voltage VIN (e.g., a voltage rail) and a VOLTAGE CONTROL output from a controller 160. The voltage converter 150 can include an internal DAC or other circuitry (not shown) that sets the value of VREG based on the VOLTAGE CONTROL output from the controller 160. In another example, the voltage converter could be a linear power supply that provides an adjustable output based on VIN and the VOLTAGE CONTROL.

A load resistance sensor (LRS) 170 senses the resistance of the output load resistor RLOAD 120 based on the output voltage VOUT and the specified load current of the DAC 130. The controller 160 provides a sense voltage control command via the VOLTAGE CONTROL output to set the regulated voltage VREG to an initial sense voltage during a sense mode. The initial sense voltage of VREG adjusts the output voltage VOUT and enables the LRS 170 to sense the resistance of the output load resistor RLOAD 120 via a switch 180 at a given current setting of the DAC 130. The given current setting of the DAC 130 can be set via a CURRENT CONTROL output from the controller 160. The controller 160 provides a clamp control command via the VOLTAGE CONTROL output based on the sensed resistance of the output load resistor RLOAD 120 to set the regulated voltage VREG to a fixed regulated voltage during an operation mode of the circuit 100.

The fixed regulated voltage for VREG enables the output driver circuit 140 to supply a predetermined maximum load current to the output load resistor at a predetermined minimum setting of the output voltage, in one example. As shown, the controller 160 can activate a switch 180 (or switches) to enable load resistance sensing by the LRS 170 during the sensing mode concurrently with providing the initial sense voltage of VREG. All of the components 110 through 180 can be fabricated on a substrate 190, where the load resistor RLOAD 120 is external and supplied by a user's application. As noted previously, the substrate 190 can include a semiconductor and/or printed circuit board substrate.

The controller 160 commands the value of the voltage converter 150 output voltage VREG to a fixed or clamp value to provide a balance between power dissipation and settling time in the circuit. This can be achieved by employing the LRS 170 to sense the resistance of the output load resistor RLOAD 120 that is driven from the output driver circuit 140. The controller 160 selects an initial voltage for the voltage converter 150 via the VOLTAGE CONTROL to set VREG for drive the output driver circuit 140 and to enable the LRS 170 to sense the resistance of the output load resistor RLOAD 120. The initial voltage can be based on predetermined (e.g., an expected range of) load conditions and an internal circuit threshold, for example. By way of example, VREG can be commanded to an initial setting of about nine volts which would support a minimum voltage VOUT at a maximum value of RLOAD 120 (e.g., 1.2 k ohms). If the DAC output is above a minimum threshold for sensing (e.g., above ¼ full scale IOUT), the LRS 170 includes circuits that are a function of both the commanded DAC current value and the load resistance. Based on this functional relationship between commanded current and resistance, the load resistance can be determined by the LRS 170 and the controller 160 at the initial voltage setting for the voltage converter 150.

After the resistance of the output load resistor 120 is determined by the controller 160 based on the sensor signal from LRS 170, the controller selects a clamp voltage to set VREG to a substantially fixed value. VREG sets an output voltage VOUT for the output driver circuit 140 based on the determined resistance value such that a predetermined load current is delivered (e.g., up to a maximum load current) to the output load resistor RLOAD 120 at the output voltage VOUT (e.g., minimum voltage to supply maximum load current). The VOLTAGE CONTROL thus sets the voltage converter voltage VREG at a fixed level for continuing circuit operations regardless of changes to the specified DAC 130 current output value. The predetermined load current can be based on predetermined maximum load current conditions, for example. Thus, the clamp voltage can be set to minimize output power in the output driver circuit 140 under maximum load current conditions in view of the determined load resistance, which is external to the circuit contained by the substrate. By clamping the output voltage VOUT to a fixed value, settling time of the output driver circuit 140 is mitigated since commanded current changes to the DAC 130 do not cause a subsequent change in voltage converter output voltage VREG. Thus, a balance can be achieved by minimizing power under maximum load current conditions at the determined resistance and mitigating settling time issues by holding the voltage converter 150 at a substantially constant level regardless of DAC current changes.

In one example, the circuit can provide a register programmable clamp for the minimum output voltage of the voltage converter 150 in both buck and boost modes, while the minimum output voltage supports maximum load current. Thus, at ILOAD MAX (a maximum IOUT) and VLOAD MIN (minimum value for VOUT), power is set substantially to a minimum value. The circuit 100 enables automatic detection of load resistance magnitude by sensing the voltage at the current output node from the output current circuit 110 during the sensing mode via activating the switch 180. The resistance sensing/detection of the LRS 170 can be valid for substantially all current values above a minimum threshold for the DAC output current (e.g., valid RLOAD resistance detected above ¼ full scale output of the DAC to satisfy circuit tolerance of the LRS). One beneficial aspect of setting the measurement threshold to a smaller value during sensing (e.g., ¼ IOUT full-scale) is that there is minimal power dissipation at lower current levels.

The controller 160 provides a digital control loop supporting the sensing mode which determines the clamp value to minimize settling time while adjusting VREG to reduce power consumption under predetermined load conditions. As shown, the controller 160 receives an APPLICATION INPUT, which can include DAC current commands from the user's application or other circuitry. The APPLICATION INPUT can also include control commands such as a command to cause the controller 160 to enter sensing mode and detect the resistance of RLOAD 120. In other examples, the sensing mode can be entered in conjunction with a power-up and/or reset process implemented by the controller 160.

Figure 2:
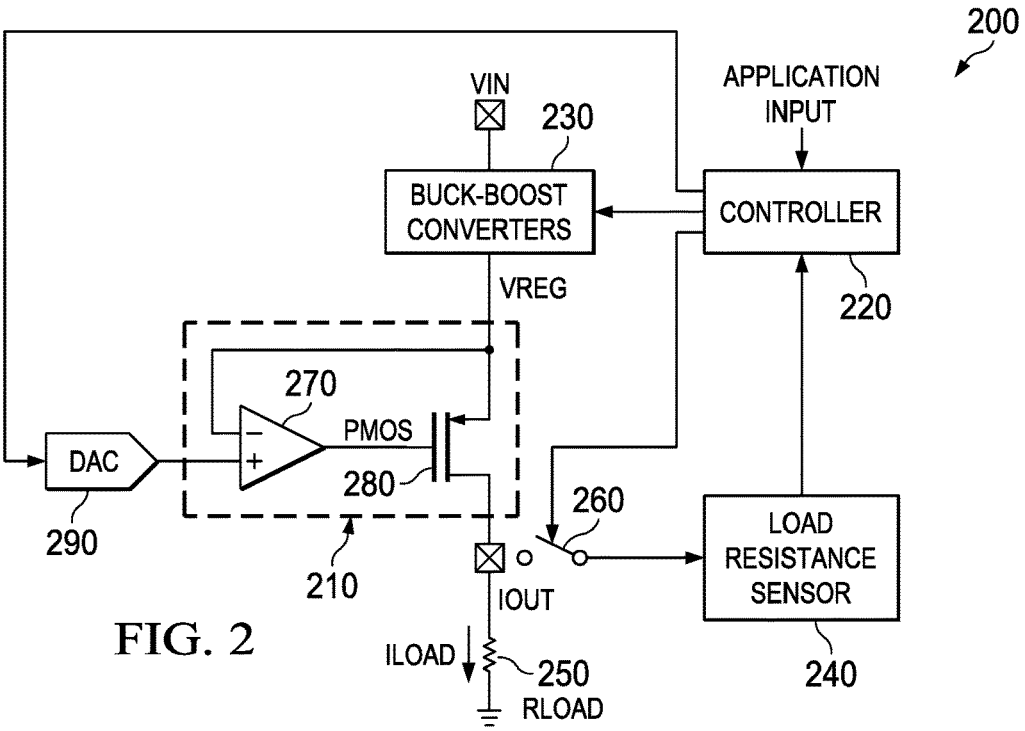
FIG. 2 illustrates an example of a circuit to generate load current via an example output driver circuit.

FIG. 2 illustrates an example of a circuit 200 to generate load current via an example output driver circuit 210 (e.g., corresponding to circuit 140 of FIG. 1). The circuit 200 includes a controller 220 that provides a voltage control signal to set a regulated voltage VREG provided by a buck/boost converter circuit 230 based on an input voltage VIN. A load resistance sensor (LRS) 240 connects to an output node to sense the resistance of a load resistor RLOAD 250 based on activation of switch 260 by the controller 220. The voltage VREG is provided to the output driver circuit 210 to generate an output current IOUT. In this example, the output driver circuit 210 can include amplifier 270 which drives power device 280 (e.g., PMOS transistor device) to provide IOUT to RLOAD 250. The output driver circuit 210 receives current commands from DAC 290 which in turn receives its respective digital input to specify IOUT from the controller 220.

Figure 3:
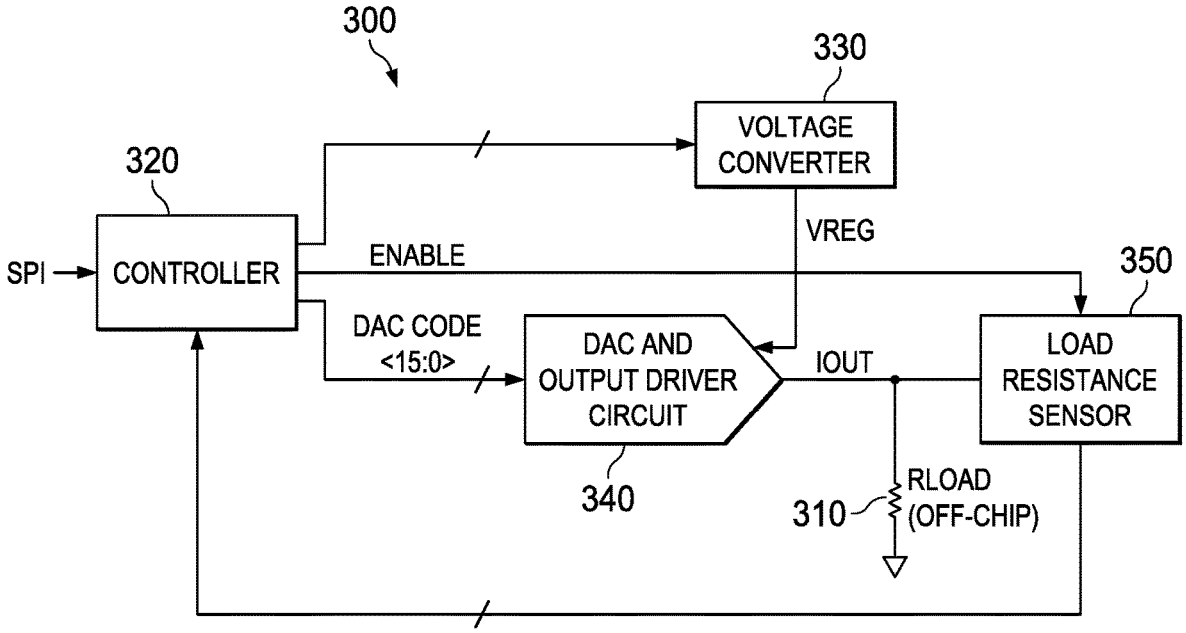
FIG. 3 illustrates an example control loop circuit to sense a resistance of a load resistor.

FIG. 3 illustrates an example digital control loop circuit 300 to sense a resistance of a load resistor RLOAD 310 and setting a regulated voltage VREG to achieve reduced power consumption and minimize settling time. A controller 320 sets an initial value for VREG via voltage converter 330. The initial value could be set at about VREG=9V, for example. The initial VREG represents a voltage to supply at least a minimum current IOUT through up to a maximum RLOAD 310 at a minimum threshold current setting for enabling suitable circuit operations. As shown, the controller 320 can receive application commands from an interface (e.g., serial peripheral interface (SPI)), for example.

After the initial setting for VREG which is supplied to a DAC and output circuit 340 to generate IOUT, the controller 320 supplies an ENABLE signal to a load resistance sensor 350, such as to connect the sensor to monitor an output voltage across an external load resistor 310. The controller 320 can also receive input of DAC code via the interface (e.g., monitoring user application for DAC output commands). If DAC_CODE is greater than a minimum threshold setting (e.g., greater than ¼ a full scale), the ENABLE signal can be set TRUE which causes the LRS 350 to perform a conversion (e.g., analog to digital conversion). After the conversion, the controller 320 samples the output from the LRS 350 to determine a value for RLOAD 310. With RLOAD being determined, the controller 320 issues a clamp command to the voltage converter 330 for supplying VREG at a fixed value based on the sensed RLOAD. For example, a set of clamp commands can be stored in a look-up table or other memory structure that is indexed based on the sensed value determined for RLOAD. Since the voltage converter can include an internal DAC, the internal DAC can be set to substantially the same digital value as that read from the LRS 350, in one example.

Figure 4:
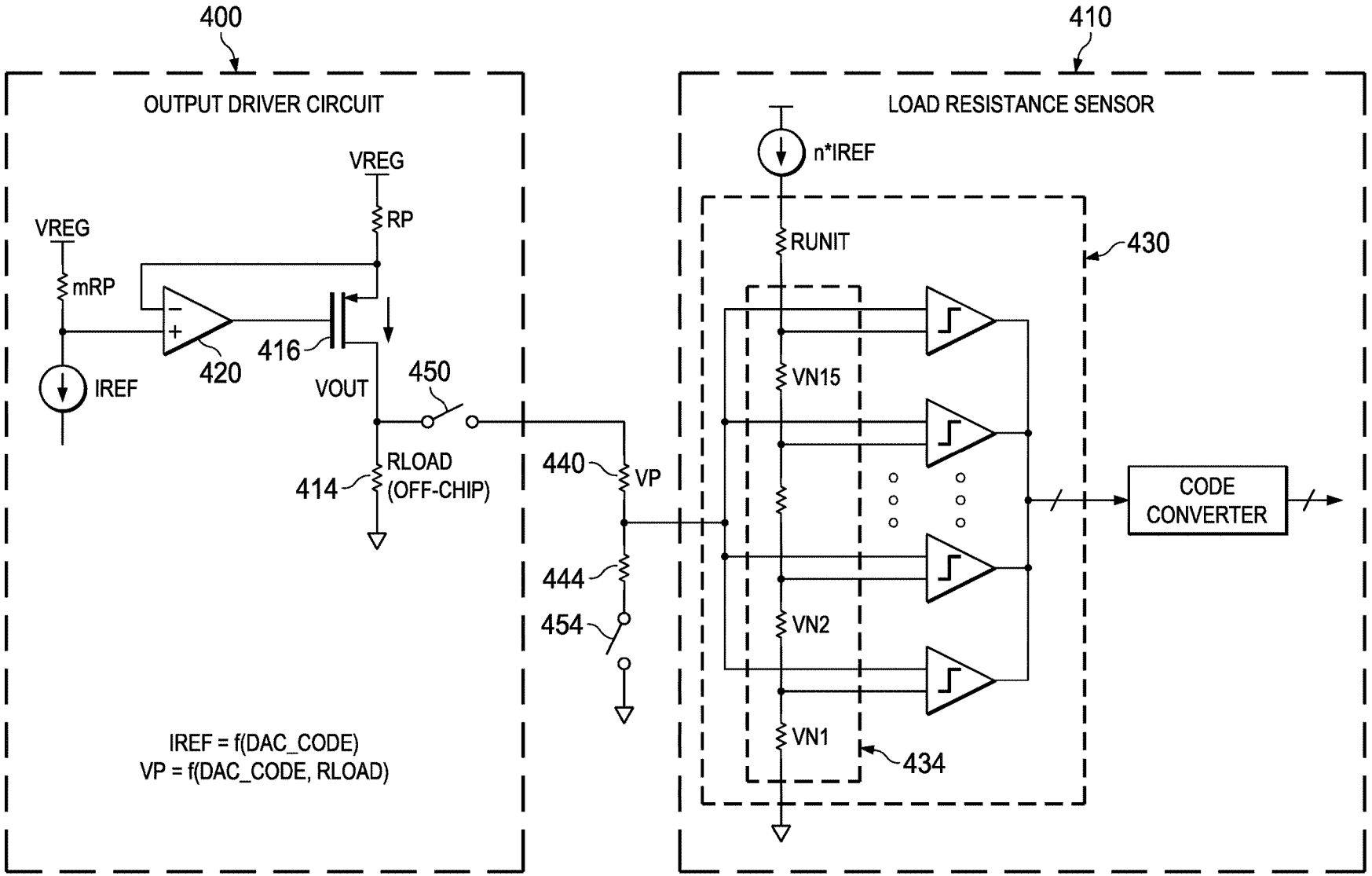
FIG. 4 illustrates an example of an output driver circuit and load resistance sensor.

FIG. 4 illustrates an example of an output driver circuit 400 and load resistance sensor (LRS) 410 (e.g., corresponding to the DAC output circuit 340 and the LRS 350 of FIG. 3). The LRS can be connected to sense a resistance of an output load resistor RLOAD 414, which can be external to the output driver circuit. The output driver circuit 410 includes a power device 416 that drives load resistor RLOAD 414. The power device 416 is supplied via VREG through resistor RP (e.g., 60 ohms). Amplifier 420 drives power device 416 and receives input current IREF which is a function of the DAC code described herein. The current IREF is tied to source VREG via resistor m*RP, wherein m is a positive integer (e.g., about 60) denoting a multiplication factor that is applied to the value of RP. The LRS 410 can include a flash analog to digital converter (ADC) 430 that includes a plurality of conversion stages. While four conversion stages are shown in the example ADC 430 in FIG. 4, more or less than four can be provided (e.g., 16 stages or other numbers of stages).

In the example of FIG. 4, each conversion stage includes a comparator the compares a reference supplied by a divider network 434. The comparators receive voltage VP via divider resistors 440 and 444. The dividers network is driven from current source n*IREF, where n is a positive integer and IREF is generated in the output driver circuit 400. Thus, the voltage VP can be detected as a function of the DAC code which determined IREF and the resistance of RLOAD 414. As shown, switches 450 and 454 can be provided to enable the LRS 410. Output from the ADC 430 can be sent to a code converter 460 (e.g., 16 to 4 bit thermometer to binary code converter). Output from the code converter 460 is provided to a controller (e.g., controller 160, 220 or 320 described herein) to determine the value of RLOAD 414. In one example, the controller sends the ADC output from the converter 460 to set the internal DAC value of the voltage converter described herein to the same value as the ADC output. The LRS 410 thus includes circuits that operate as a function of both the commanded DAC current value (e.g., proportional to IREF) and the load resistance. Based on this functional relationship between commanded current and resistance, the load resistance can be determined by the LRS and the controller at the initial voltage setting for the voltage converter.

As one example, to provide additional context, in the sensing mode, RLOAD 414 can be sensed and supply voltage set such that voltage converter is able to provide up to about 24 mA at the sensed resistance of RLOAD, for example. Some example parameter values for the circuits 400 and 410 include m=60, RP=60, n=1/16, IREF=0 to 400 uA for normal operation mode, RUNIT=4 k, VP=VOUT/12, RLOAD=500 Ohms, DAC_CODE=¼FS for sensing mode and thus IREF=100 uA, and initial CLAMP setting for voltage converter (not shown)=8000. This can be utilized set the DCDC output voltage to about 15V which can provide 24 mA to the output load of 500 Ohms, where VOUT is approximately 12V minus drops across RP and power device 416.

Figure 5:
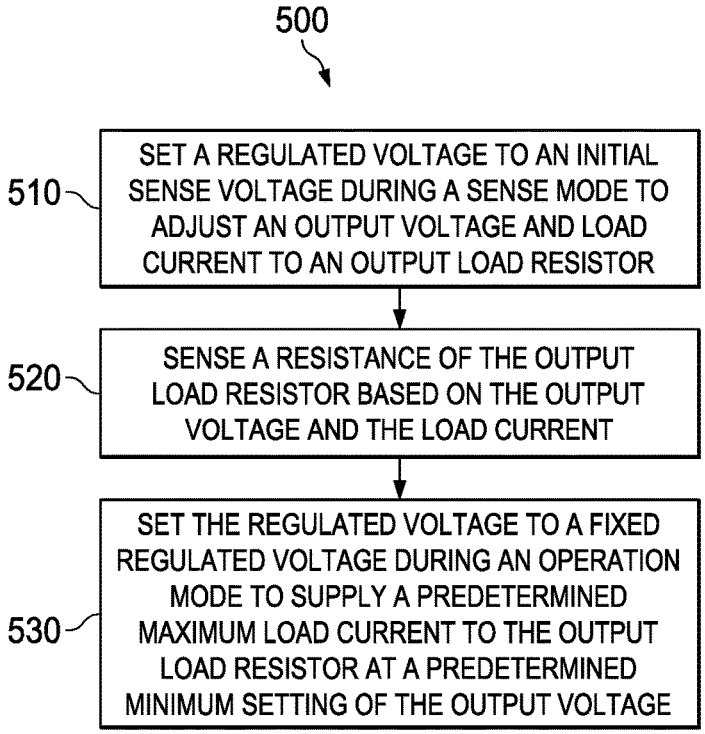
FIG. 5 illustrates an example method to generate current to an output load resistor.

In view of the foregoing structural and functional features described above, a method will be better appreciated with reference to FIG. 5. While, for purposes of simplicity of explanation, the method is shown and described as executing serially, it is to be understood and appreciated that the method is not limited by the illustrated order, as some aspects could, in other examples, occur in different orders and/or concurrently with other aspects from that shown and described herein. Moreover, not all illustrated features may be required to implement a method. The various acts of the method can be executed automatically such as via a processor, computer, and/or controller configured with executable instructions to carry out the various acts or commands described herein.

FIG. 5 illustrates an example method 500 to generate current to an output load resistor. At 510, the method 500 includes setting a regulated voltage to an initial sense voltage during a sense mode (e.g., via controller 160 and voltage converter 150 of FIG. 1). The initial sense voltage adjusts an output voltage of an output current circuit to an output load resistor at a given setting of load current. At 520, the method 500 includes sensing a resistance of the output load resistor based on the output voltage and the load current (e.g., via controller 160 and LRS 170 of FIG. 1). At 530, the method 500 includes setting the regulated voltage to a fixed regulated voltage during an operation mode (e.g., via controller 160 and voltage converter 150 of FIG. 1). The fixed regulated voltage enables the output current circuit to supply a predetermined maximum load current to the output load resistor at a predetermined minimum setting of the output voltage. As a result, the method 500 can minimize settling time for the output circuit while adaptively buck/boosting the power supply for supplying current to the external load so as to reduce power consumption. Although not shown, the method 500 can also include setting the load current during the sense mode to a predetermined minimum value to enable sensing of the resistance of the output load resistance above a circuit tolerance threshold. This can include measuring the resistance of the output load resistor as a function of commanded load current and voltage supplied to the output load resistor.

What have been described above are examples. It is, of course, not possible to describe every conceivable combination of components or methodologies, but one of ordinary skill in the art will recognize that many further combinations and permutations are possible. Accordingly, the disclosure is intended to embrace all such alterations, modifications, and variations that fall within the scope of this application, including the appended claims. As used herein, the term "includes" means includes but not limited to, the term "including" means including but not limited to. The term "based on" means based at least in part on. Additionally, where the disclosure or claims recite "a," "an," "a first," or "another" element, or the equivalent thereof, it should be interpreted to include one or more than one such element, neither requiring nor excluding two or more such elements.

What is claimed is:

1. A circuit, comprising:

an output current circuit including:

a voltage converter having an input coupled to a supply voltage source and an output;

a digital to analog converter (DAC) having an input configured to receive a current command specifying a current to be delivered to an output load resistor in response to the control command, and having a DAC output; and an output driver circuit coupled to the output of the voltage converter and having an input coupled to the DAC output, and having an output;

a load resistance sensor (LRS) having an input selectively coupled to the output of the output driver circuit, wherein the LRS includes an analog to digital converter (ADC) coupled to a node having a voltage corresponding to the DAC output voltage, the ADC further including a plurality of conversion stages, each of the conversion stages having a comparator with a first input coupled to a reference supplied by a divider network having a reference current flowing into the divider network and a second input coupled to the node having a voltage corresponding to the DAC output voltage;

a controller coupled to a serial data port and having:

a first output coupled to the voltage converter and configured to provide a control command in each of a sense mode and a normal operation mode, the control command setting sets the voltage at the output of the voltage converter to a first non-zero voltage during the sense mode and to a second non-zero voltage during the normal operation mode, the second voltage determined based on the sensed resistance of the output load resistor;

a second output coupled to the DAC and configured to provide the current command specifying the amount of current to be sourced from the output of the output driver circuit; and a third output coupled to a control input of a switch that selects the sense mode or the normal operation mode.

2. The circuit of claim 1, wherein the voltage converter further includes at least one of: a buck converter, a boost converter, and a linear power supply to generate the regulated voltage.

3. The circuit of claim 1, wherein the LRS further includes a divider circuit configured to measure the resistance of the output load resistor as a function of the load current and the output voltage provided to the output load resistor.

4. The circuit of claim 1, wherein the current command specifies a percentage of full scale load current to be delivered to the output load resistor.

5. The circuit of claim 1, wherein the output driver circuit further includes an output driver configured to receive an output from the DAC specifying a percentage of full scale load current to be delivered and to provide the load current through the output load resistor in response to the output from the DAC and the regulated voltage.

6. The circuit of claim 5, wherein the output driver circuit further includes an amplifier configured to amplify the output from the DAC and a power device configured to provide the load current to the output load resistor in response to the amplifier output from the amplifier.

7. The circuit of claim 1, wherein the controller operates in the sense mode at a first value of the load current to enable the LRS to sense the resistance of the output load resistance above a circuit tolerance threshold of the LRS.

8. The circuit of claim 1, further including:

at least one controllable switch coupled to and activated by the controller, and configured to connect the LRS to the output load resistor to sense the resistance of the output load resistor.

9. The circuit of claim 1, wherein the sense mode occurs in conjunction with at least one of: a power up sequence and reset process of the controller.

10. The circuit of claim 1, wherein the circuit operates in the sense mode in response to the controller providing a signal to enable the LRS, and the circuit transitions to the normal operation mode in response to the controller providing a signal to disable the LRS.

11. A circuit comprising:

a voltage converter having an input coupled to a supply voltage source and an output;

a digital to analog converter (DAC) having an input configured to receive a current command specifying a load current to be provided to an output load resistor, and having a DAC output;

an output driver circuit having a first input coupled to the output of the voltage converter, having a second input coupled to the output of the DAC, and having an output;

a load resistance sensor (LRS) having an input selectively coupled to the output of the output driver circuit, wherein the LRS includes an analog to digital converter (ADC) having an input coupled to a node having a voltage corresponding to the voltage across the output load resistor, the ADC further including a plurality of conversion stages, each of the conversion stages including a comparator with a first input coupled to a reference supplied by a resistive divider network having a reference current flowing into the resistive divider network, and a second input coupled to the node having a voltage corresponding to the DAC output voltage; and a controller coupled to a serial data port and having:

a first output coupled to the voltage converter and configured to provide a control command in each of a sense mode and a normal operation mode, the control command setting the voltage at the output of the voltage converter to a first non-zero voltage during the sense mode and to a second non-zero voltage during the normal operation mode, the second voltage being determined based on the sensed resistance of the output load resistor; and a second output coupled to the DAC and configured to provide the current command specifying the amount of current to be sourced from the output of the output driver circuit.

12. The circuit of claim 11, wherein the voltage converter further comprises at least one of a buck converter, a boost converter and a linear power supply to generate the regulated voltage.

13. The circuit of claim 11, wherein the output driver circuit further comprises an amplifier configured to amplify an output from the DAC and a power device configured to provide the load current to the output load resistor in response to the amplified output from the amplifier.

14. The circuit of claim 11, wherein the controller operates in the sense mode at a first value of the load current to enable the LRS to sense the resistance of the output load resistance above a circuit tolerance threshold of the LRS.

15. The circuit of claim 11, further including:

at least one controllable switch coupled to and activated by the controller, and configured to connect the LRS to the output load resistor to sense the resistance of the output load resistor.

* * * * *